US008125308B1

(12) United States Patent
Barton

(10) Patent No.: US 8,125,308 B1
(45) Date of Patent: Feb. 28, 2012

(54) RELOCATABLE POWER TAP WITH SURGE SUPPRESSION OR SURGE PROTECTION AND A METHOD FOR ITS MANUFACTURE

(76) Inventor: Bruce Barton, Huntington, NY (US)

( * ) Notice: Subject to any disclaimer, the term of this patent is extended or adjusted under 35 U.S.C. 154(b) by 352 days.

(21) Appl. No.: 12/417,514

(22) Filed: Apr. 2, 2009

(51) Int. Cl.
*H01C 7/10* (2006.01)

(52) U.S. Cl. ..... 338/21

(58) Field of Classification Search ..... 338/21, 338/226, 233, 237, 262
See application file for complete search history.

(56) References Cited

U.S. PATENT DOCUMENTS

| | | | | |
|---|---|---|---|---|
| 4,827,370 | A * | 5/1989 | St-Jean et al. | 361/127 |
| 5,227,944 | A * | 7/1993 | Eggendorfer | 361/103 |
| 5,896,264 | A * | 4/1999 | Bijlenga et al. | 361/106 |
| 5,936,824 | A * | 8/1999 | Carpenter, Jr. | 361/126 |
| 7,505,241 | B2 * | 3/2009 | McLoughlin et al. | 361/124 |
| 7,808,364 | B2 * | 10/2010 | Chou et al. | 338/21 |
| 2008/0117555 | A1 * | 5/2008 | Wilson et al. | 361/13 |

* cited by examiner

*Primary Examiner* — James Harvey
(74) *Attorney, Agent, or Firm* — Edwin D. Schindler

(57) ABSTRACT

A relocatable power tap includes surge suppression or surge protection for affording improved safety, in which the metal oxide varistors ("MOVs") of the surge protectors or surge suppressors are encased in cement or concrete, and which relocatable power tap is preferably formed as part of an electrical power strip. The method for manufacturing the relocatable power tap includes the step of encasing the metal oxide varistors ("MOVs") of the surge protector, or surge suppressor, in cement or concrete, or similar fire-resistant material.

26 Claims, 3 Drawing Sheets

RELOCATABLE POWER TAP WITH SURGE SUPPRESSION OR SURGE PROTECTION AND A METHOD FOR ITS MANUFACTURE

BACKGROUND OF THE INVENTION

Technical Field of the Invention

The present invention relates, generally, to a relocatable power tap with surge suppression or surge protection for the distribution of electrical power, which provides increased safety, as compared to similar electrical devices currently known to the prior art, and a method for the manufacture of the relocatable power tap having built-in surge protection or surge protection of the present invention.

More particularly, the present invention relates a relocatable power tap having surge protection or surge suppression for the distribution of electrical power, preferably formed as part of an electrical power strip, along with a method for its manufacture, having improved safety for minimizing, if not outright preventing, an electrical fire or similar occurrence that may otherwise result from overheating.

SUMMARY OF THE INVENTION

It is, therefore an object of the present invention to provide a relocatable power tap having surge protection or surge suppression for the distribution of electrical power formed as an electrical power.

It is a further object of the present invention to provide a relocatable power tap for distribution of electrical power formed as an electrical power strip and having surge protection or surge suppression that is capable of meeting, if not exceeding, standardized industrial safety tests.

It is an additional object of the present invention to provide a method for the manufacture of a relocatable power tap having surge protection or surge suppression for the distribution of electrical power formed as part of an electrical power strip.

The foregoing and related objects are accomplished by the present invention, which provides a relocatable power tap having surge suppression or surge protection thereby affording improved safety, as compared to similar conventional devices, in which the metal oxide varistors ("MOVs") of the surge protectors or surge suppressors are encased in cement or concrete, and which relocatable power tap is preferably formed as part of an electrical power strip. The method for manufacturing the relocatable power tap having surge suppression or surge protection of the invention includes the step of encasing the metal oxide varistors ("MOVs") of the surge protector, or surge suppressor, in cement or concrete, or similar fire-resistant material.

MOVs are known to the skilled artisan to have a significant tendency to overheat and catch fire during certain types of surges, thereby creating a safety hazard. Cement or concrete is a low-cost mate-rial that is readily available, fire resistant, and easy to work with, thereby making cement or concrete ideal for use in surge protectors for guarding against fires caused by overheat-ing of MOVs.

It is anticipated that by encasing the MOVs of surge protectors, or surge suppressors, in cement or concrete that the resulting article would readily meet, or exceed, industry safety standards, such as those set forth by Underwriters Laboratories Inc. (UL) 1449—*UL Standard for Safety for Surge Protective Devices* (3d Edition.)

Other objects and features of the present invention will become apparent when considered in combination with the accompanying drawing figures which illustrate certain preferred embodiments of the present invention. It should, however, be noted that the accompanying drawing figures are intended to illustrate only certain embodiments of the claimed invention and are not intended as a means for defining the limits and scope of the invention.

BRIEF DESCRIPTION OF THE DRAWING FIGURES

In the drawing, wherein similar reference numerals and symbols denote similar features throughout the several views.

DETAILED DESCRIPTION OF THE PREFERRED EMBODIMENTS AND DRAWING FIGURES

Figure 1:
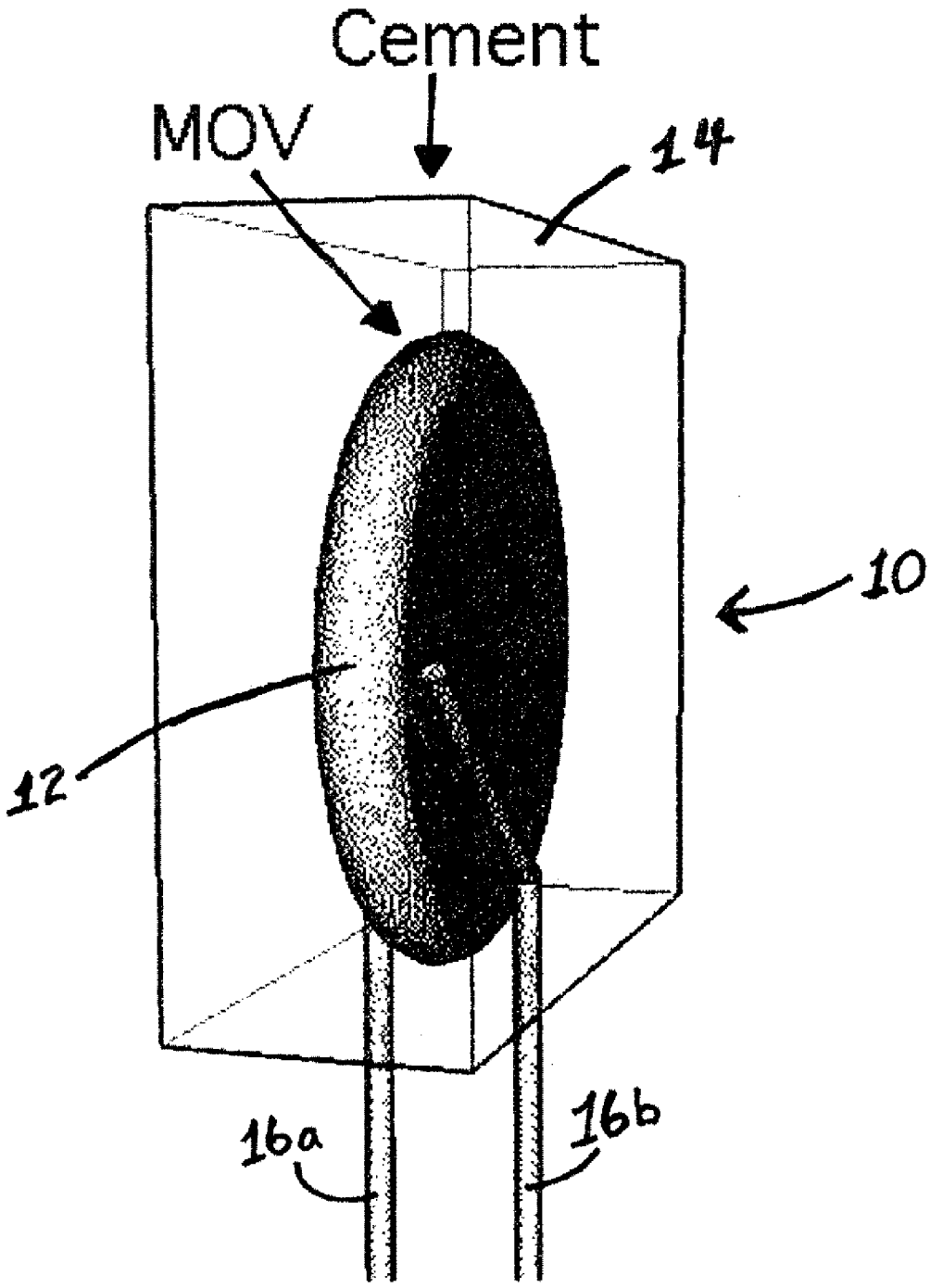
FIG. 1 is a perspective view showing a metal oxide varistor (MOV) encased in cement according to the method of the present invention.

Turning now, in detail, to the accompanying drawing figures, FIG. 1 presents a perspective view of a module 10 to be used in a relocatable power tap in accordance with the present invention, in which a metal oxide varistor ("MOV") 12 is encased in cement 14 or similar hardened material. Wires 16*a*, 16*b*, lead to, and from, MOV device 12 within cement 14. A module 10 may be formed by using a mold for encasing MOV 12 in cement, concrete or similar fire-resistant material, or by dipping the MOV in cement or similar hardening or curing material, and subsequently allowed to harden.

Figure 2:
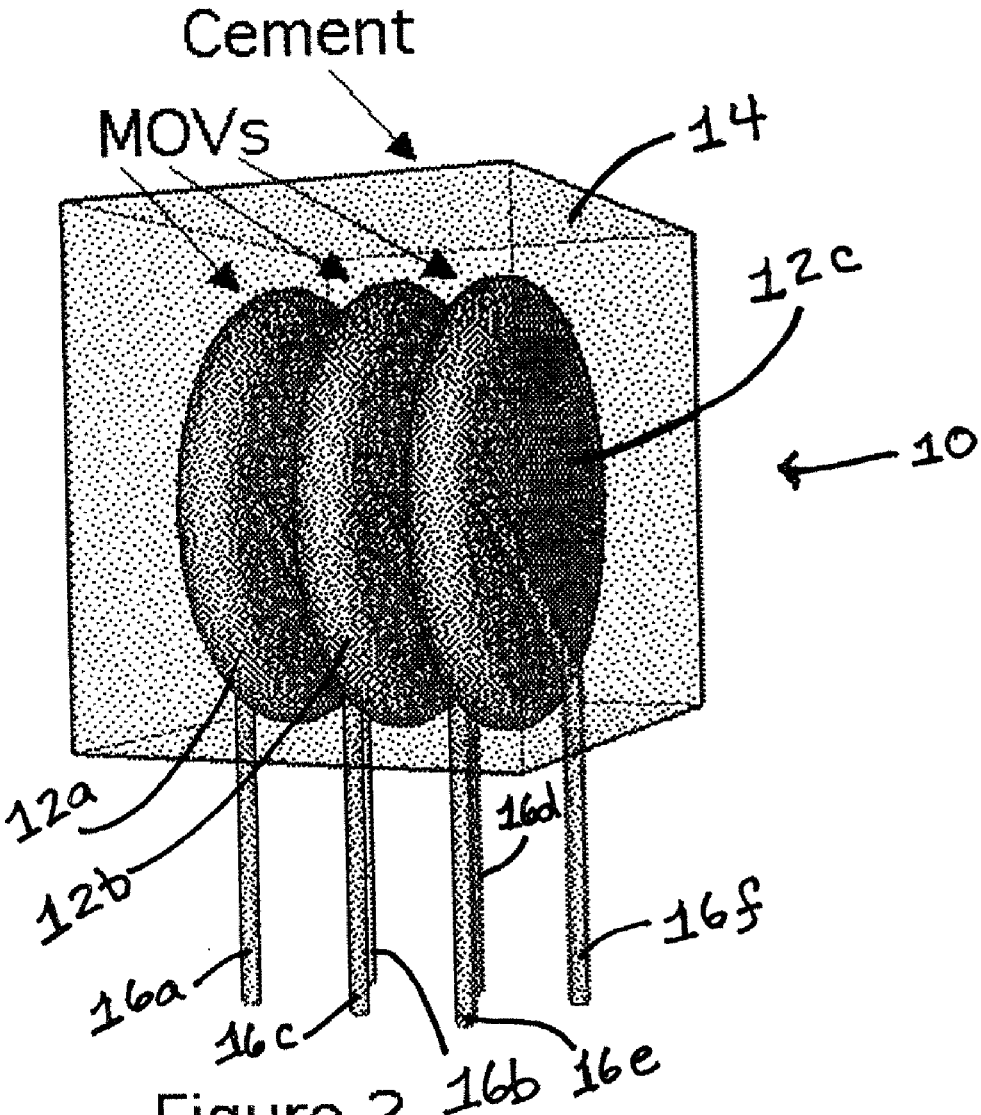
FIG. 2 is a perspective view showing multiple metal oxide varistors (MOVs) encased in cement according to the method of the present invention.

FIG. 2 provides a perspective view similar to that of FIG. 1, except that the module 10 for use in a relocatable power tap is shown as having a plurality of MOV devices, 12*a*, 12*b*, 12*c*, encased within cement 14 with lead wires 12*a*, 12*b*, 12*c*, 12*d*, 12*e*, 12*f*, leading from the three MOV devices illustrated in FIG. 2.

Figure 3:
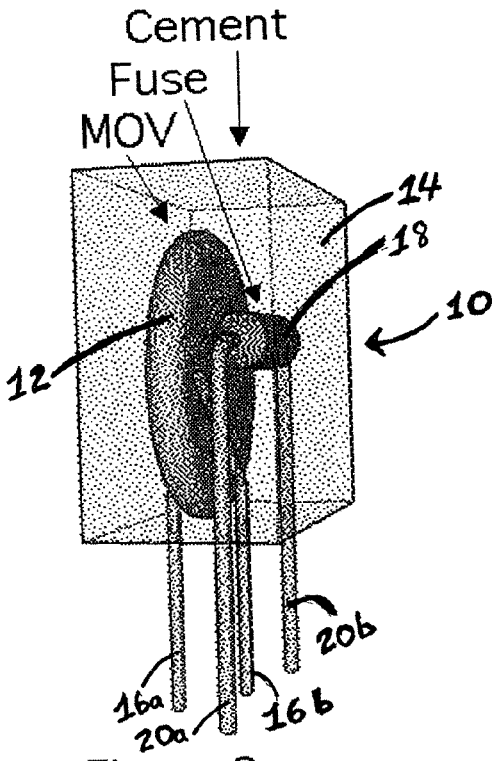
FIG. 3 is a perspective view of a metal oxide varistor (MOV) with a thermal fuse, the combination of which is encased in cement according to the present invention; and, FIG. 4 is a perspective view of a metal oxide varistor (MOV) covered in cement with the mold still present in accordance with the present invention.

FIG. 3 provides a further perspective view of the module 10 for use in a relocatable power tap of the present invention, in which thermal fuse 18 (or a plurality of thermal fuses) may be encased in cement 14, along with MOV device 12, or simply placed in contact with one or more MOV devices 12 which are encased in cement 14. Lead wires 16*a*, 16*b* lead to, and from, MOV device 12, while lead wires 20*a*, 20*b* lead to, and from, thermal fuse 18.

Figure 4:
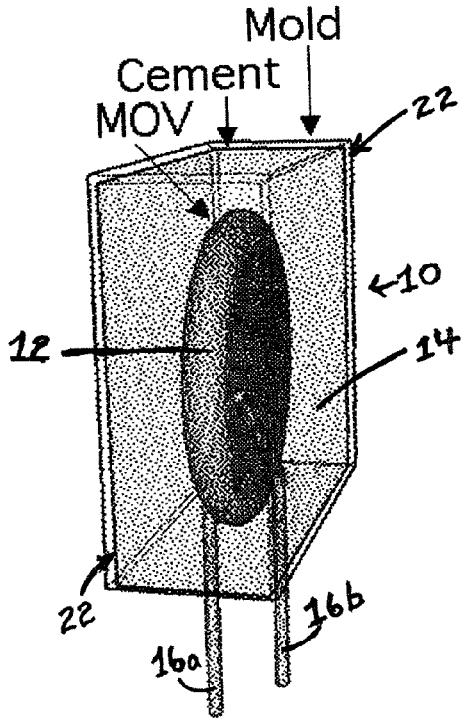

FIG. 4 illustrates an alternative, preferred embodiment of the present invention for module 10 for use in relocatable power tap, wherein cement 14 may, for example, first be poured into a mold 22 after MOV device 12 is mounted to a circuit board. Mold 22 may either be removed from the final product or simply retained as an additional reinforcing means, which mold may be comprised of such materials as, e.g., Fiberglass, or reinforced with a reinforcing tape.

While only several embodiments of the present invention have been shown and described, it will be obvious to those skilled in the art that many modifications may be made to the present invention without departing from the spirit and scope thereof.

What is claimed is:

1. A relocatable power tap for electrical distribution, comprising:

means for surge suppression or surge protection;

a metal oxide varistor; and, a hardened, fire-resistant material encasing said metal oxide varistor; wherein said hardened, fire-resistant material encasing said metal oxide varistor is cement or concrete.

2. The relocatable power tap for electrical distribution according to claim 1, wherein said means for surge suppression or surge protection forms a part of an electrical power strip.

3. The relocatable power tap for electrical distribution according to claim 1, further comprising at least one additional said metal oxide varistor.

4. A method for producing a relocatable power tap for electrical distribution, comprising the steps of:

providing a metal oxide varistor; and, encasing the metal oxide varistor in a hardened, fire-resistant material;

wherein said hardened, fire-resistant material encasing said metal oxide varistor is cement or concrete.

5. The relocatable power tap for electrical distribution according to claim 1, further comprising reinforcing means for said fire-resistant material encasing said metal oxide varistor.

6. The relocatable power tap for electrical distribution according to claim 5, wherein said reinforcing means is a mold encircling, or encasing, said fire-resistant material encasing said metal oxide varistor.

7. The relocatable power tap for electrical distribution according to claim 6, wherein said mold is reinforced with Fiberglass.

8. The relocatable power tap for electrical distribution according to claim 6, wherein said mold is reinforced with Fiberglass reinforcing tape.

9. The relocatable power tap for electrical distribution according to claim 1, further comprising at least one thermal fuse encased within said hardened, fire-resistant material encased along with said metal oxide varistor.

10. The relocatable power tap for electrical distribution according to claim 1, further comprising at least one thermal fuse encased in contact with at least one said metal oxide varistor.

11. The method for producing a relocatable power tap for electrical distribution according to claim 4, wherein said step of encasing the metal oxide varistor in a hardened, fire-resistant material includes the sub-steps of:

providing a mold;

pouring a liquefied fire-resistant material into the mold;

placing the metal oxide varistor into the mold; and, allowing the liquefied fire-resistant material to solidify.

12. The method for producing a relocatable power tap for electrical distribution according to claim 11, further including the sub-step of:

placing a thermal fuse into the mold.

13. The method for producing a relocatable power tap for electrical distribution according to claim 4, further comprising the step of:

reinforcing the fire-resistant material encasing the metal oxide varistor.

14. The method for producing a relocatable power tap for electrical distribution according to claim 4, further comprising the step of:

providing at least one thermal fuse encased within the hardened, fire-resistant material encased along with the metal oxide varistor.

15. The method for producing a relocatable power tap for electrical distribution according to claim 4, wherein said step of encasing the metal oxide varistor in a hardened, fire-resistant material is performed via dipping the metal oxide varistor in cement or concrete.

16. The method for producing a relocatable power tap for electrical distribution according to claim 11, further including the sub-step of:

retaining the mold about, and encasing, the metal oxide varistor.

17. The method for producing a relocatable power tap for electrical distribution according to claim 16, further including the sub-step of:

reinforcing the mold about, and encasing, the metal oxide varistor.

18. The method for producing a relocatable power tap for electrical distribution according to claim 17, wherein said sub-step of reinforcing the mold about, and encasing, the metal oxide varistor including reinforcement with Fiberglass.

19. A relocatable power tap for electrical distribution, comprising:

means for surge suppression or surge protection;

a metal oxide varistor;

a hardened, fire-resistant material encasing said metal oxide varistor; and, reinforcing means for said fire-resistant material encasing said metal oxide varistor, said reinforcing means being a mold encircling, or encasing, said fire-resistant material enveloping said metal oxide varistor.

20. The relocatable power tap for electrical distribution according to claim 19 , wherein said mold is reinforced with Fiberglass.

21. The relocatable power tap for electrical distribution according to claim 19 , wherein said mold is reinforced with Fiberglass reinforcing tape.

22. A method for producing a relocatable power tap for electrical distribution, comprising the steps of providing a metal oxide varistor; and, encasing the metal oxide varistor in a hardened, fire-resistant material, said step of encasing the metal oxide varistor includes the sub-steps of:

providing a mold;

pouring a liquefied fire-resistant material into the mold;

placing the metal oxide varistor into the mold; and, allowing the liquefied fire-resistant material to solidify.

23. The method for producing a relocatable power tap for electrical distribution according to claim 22, further including the sub-step of:

placing a thermal fuse into the mold.

24. The method for producing a relocatable power tap for electrical distribution according to claim 22, further including the sub-step of:

retaining the mold about, and encasing, the metal oxide varistor.

25. The method for producing a relocatable power tap for electrical distribution according to claim 24, further including the sub-step of:

reinforcing the mold about, and encasing, the metal oxide varistor.

26. The method for producing a relocatable power tap for electrical distribution according to claim 25, wherein said sub-step of reinforcing the mold about, and encasing, the metal oxide varistor including reinforcement with Fiberglass.

* * * * *